United States Patent [19]

Rogers, Jr.

[11] 4,350,387

[45] Sep. 21, 1982

[54] RECLINING CHAIR WITH IMPROVED ACTUATION

[75] Inventor: Walter C. Rogers, Jr., Denton, N.C.

[73] Assignee: Parma Corporation, Denton, N.C.

[21] Appl. No.: 199,595

[22] Filed: Oct. 22, 1980

[51] Int. Cl.[3] ..... A47C 1/02

[52] U.S. Cl. ..... 297/85; 297/322

[58] Field of Search ..... 297/84, 85, 322, 68, 297/83

[56] References Cited

U.S. PATENT DOCUMENTS

| | | | |
|---|---|---|---|
| 3,768,859 | 10/1973 | Rogers, Jr. et al. | 297/85 |
| 3,941,417 | 3/1976 | Re | 297/85 |
| 4,025,113 | 5/1977 | Rogers, Jr. | 297/84 |
| 4,108,491 | 8/1978 | Rogers, Jr. | 297/85 |
| 4,185,869 | 1/1980 | Rogers, Jr. | 297/84 |
| 4,188,062 | 2/1980 | Rogers, Jr. et al. | 297/85 X |
| 4,226,469 | 10/1980 | Rogers, Jr. et al. | 297/85 |

*Primary Examiner*—Francis K. Zugel

*Attorney, Agent, or Firm*—William E. Mouzavires

[57] ABSTRACT

A three-way, wall-avoiding, reclining chair having an improved actuation system which minimizes the effort and attention required of the chair occupant to actuate the chair to reclining position from the normal generally upright position of the chair. The improved actuation system is achieved by a novel seat linkage mechanism mounting the seat and backrest to a fixed base such that when the occupant sits in the chair when the chair is in the normal generally upright position with the footrest closed, the seat linkage mechanism is urged by the occupant's weight to extend the footrest while moving the seat and backrest forwardly relative to the base into the TV position. However, a releasable lock mechanism is provided to restrain the seat linkage mechanism from moving to the TV position as aforementiond. A manually operable release is associated with the lock mechanism to allow the chair occupant to release the lock mechanism thereby allowing the chair to move into the aforementioned TV position responsive to the weight of the chair occupant. Once in the TV position, the chair may be moved to a further reclining position by the chair occupant simply applying back pressure to the backrest while opening his body causing the backrest to move relative to the seat, and the seat and backrest to move relative to the base into a more pronounced reclining position. To return to the TV position, the occupant merely has to remove pressure from the backrest or lean forwardly in the chair. To move from the TV position back to the normal, generally upright position, the occupant merely closes the footrest by applying pressure with his feet or legs on the footrest to retract the same to closed position which also actuates the seat linkage mechanism to restore the seat and backrest to the normal position.

32 Claims, 12 Drawing Figures

RECLINING CHAIR WITH IMPROVED ACTUATION

BACKGROUND OF INVENTION

The present invention relates to a wall-avoiding, reclining chair, the term "wall-avoiding" in the art meaning that the chair may be placed with the backrest adjacent a wall and moved into reclining position without the backrest striking the wall. More specifically, the present invention relates to such a chair wherein the wall-avoiding action is achieved through a linkage system which projects the seat and backrest unit forwardly relative to a fixed base when the chair moves to the TV or advanced reclining positions. In industry, the term "TV position" is applied to the position in which the chair is placed from the normal or generally upright position when the footrest is extended. Beyond the TV position, the chair may be placed into advanced or more pronounced reclining positions culminating in the fully reclined position. Such chairs as described above, as a general category, are old in the art and in this regard, reference may be had to Rogers U.S. Pat. Nos. 4,071,275 and 4,108,491.

With such wall-avoiding, reclining chairs of the prior art, the chair is manually actuated to the TV reclining position in several different ways, one for example, utilizing a manual actuating handle where the chair occupant grasps the handle and rotates it to transfer a manual force to the footrest mechanism for moving the footrest to the extended position. In other chairs such as those disclosed in Re' U.S. Pat. Nos. 3,958,827 and 3,941,417, actuation is achieved by the chair occupant applying pressure to the backrest which, through linkages, transfers forces to the footrest for extending the footrest into the TV position. Another actuating system utilizes the armrests of the chairs such as, for example, disclosed in Rogers U.S. Pat. No. 4,185,869 for driving the footrest to the TV position. In all of the aforementioned chairs actuating systems, a certain amount of force must be generated by the chair occupant either through his back, arms or hands for physically driving, through mechanical leverage, the footrest into the extended position.

In the chairs of the above-identified Rogers patents, wall-avoiding action is achieved solely through the operation of linkage mechanisms. This is to be contrasted with the wall-avoiding chairs of the above described Re' patents which chairs utilize a track and roller system for moving the seat and backrest away from a nearby wall to achieve wall-avoiding action. Although not disclosed in the aforementioned Re' patents, there exists in the prior art, wall-avoiding reclining chairs utilizing roller and track systems, wherein the tracks are inclined for projecting the chair through gravity into the TV position upon disengagement of a pall or other catch which holds the chair in the normal generally upright position. In some cases, a spring is utilized to move the chair back into the normal position, when the occupant leaves the chair.

In many instances, wall-avoiding chairs which achieve wall-avoiding action through means of a linkage system are preferred over chairs which achieve it through a track and roller system. This is because a linkage system can be constructed to operate more smoothly in providing wall-avoiding action as opposed to rollers which at times bind in the tracks and also create undesirable noise and feelings when the rollers move over obstacles which have accumulated in the tracks. In addition, the use of a linkage system for achieving wall-avoiding action allows a smaller front-to-rear chair dimension, thereby enhancing the various styling possibilities for the overall chair. Furthermore, the linkage system for providing wall-avoiding action also serves the dual purpose of achieving the necessary reclining balance for the various reclined positions of the chair.

Turning now to the present invention, it is directed to a wall-avoiding, reclining chair which achieves wall-avoiding action solely through means of a linkage system as opposed to a roller and track system. More specifically, the present invention provides a novel and improved linkage mechanism including an improved actuation system which does away with the necessity of manually actuating the chair to the TV position through means of the backrest, the armrest, or a handle-driving mechanism so as to minimize the effort and attention required by the chair occupant to actuate the chair to the TV position.

OBJECTS OF THE INVENTION

It is an object of the present invention to provide a novel and improved recliner chair which achieves wall-avoiding action solely through a linkage mechanism and yet is actuated to the TV position through means of an improved actuation system which minimizes the amount of energy and attention required of the chair occupant. More specifically, it is an object of the present invention to provide such a chair as just described which is actuated into the TV position through the weight of the chair occupant.

Another object of the present invention is to provide a reclining chair which achieves wall-avoiding actuation through a novel and improved linkage system which, when the chair is in the normal or closed position, will be urged by the occupant's weight towards the TV position and wherein, a releasable lock mechanism is provided to prevent the chair from moving into the TV position. Included herein is such a chair including a release mechanism for releasing the lock mechanism to cause the chair to be automatically moved into the TV position by the weight of the chair occupant. It is also an object that the release mechanism be operable in one quick and simple action of the chair occupant.

Another object of the present invention is to provide such a chair which will achieve the above objects and yet, at the same time, will provide smooth operation between the various positions of the chair and which will further achieve comfortable reclining balance in the various reclined positions of the chair.

SUMMARY OF INVENTION

In summary, the present invention includes a wall-avoiding reclining chair in which the seat and backrest are mounted on a fixed base by means of a linkage mechanism which is dimensioned and arranged such that the weight of the chair occupant acting downwardly through the mechanism will automatically urge the mechanism to move into the TV position, that is, with the footrest extended and the seat displaced forwardly relative to the base.

The linkage mechanism includes front and rear primary seat mounting links utilized for mounting the seat and backrest relative to the fixed base. In the preferred embodiment, the front seat mounting link is connected to a footrest mechanism for actuating the footrest into extended position by virtue of the occupant's weight as described above. However, to prevent unwanted movement to TV position under the weight of the chair-occupant, the linkage mechanism is provided with a lock mechanism for restraining the footrest mechanism and the remainder of the linkage mechanism from moving into the TV position when the chair is in the normally, generally upright position.

In order to move into the TV position, the chair occupant must release or open the lock mechanism which, in the specific embodiment shown, is achieved through a release in the form of a small handle or lever mounted on one side of the chair. It is noted that the force required to release the lock mechanism for placing the chair into the TV position is very slight in contrast to conventional handle-operating mechanisms used to drive the footrest mechanism into the TV position. Once in the TV position, the chair of the present invention may be moved to advanced reclining positions with the footrest remaining extended, by the occupant exerting back pressure on the backrest which will cause the seat and backrest to move relative to and forwardly of the base. Furthermore in the preferred embodiment which is a three-way reclining chair, the backrest will move relative to the seat during movement into advanced reclining positions beyond the TV position. In order to return the chair to the normal or generally upright position from the TV position, the operator merely applies pressure on the footrest with his feet or legs to physically retract the footrest mechanism to closed position under the front of the seat.

DRAWINGS

Other objects and advantages of the present invention will become apparent from the following more detailed description taken in conjunction with the attached drawings in which:

FIG. 1 is a side, elevational, view of a linkage mechanism or system constituting a preferred embodiment of the invention for a three-way, wall-avoiding, reclining chair; the mechanism being shown in the closed or normal position as would be seen from the outside of the chair and with the upholstery and other frame parts of the chair removed for clarity;

FIG. 1*a* is a fragmental view of portions of the chair shown in FIG. 1 to illustrate a handle utilized for releasing a lock mechanism included in the linkage mechanism, the handle having been removed from FIG. 1 for clarity;

Figure 1A:
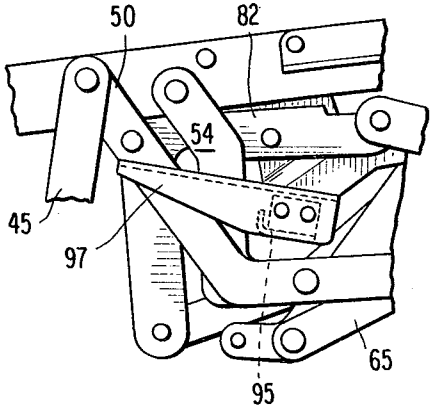
Figure 1:
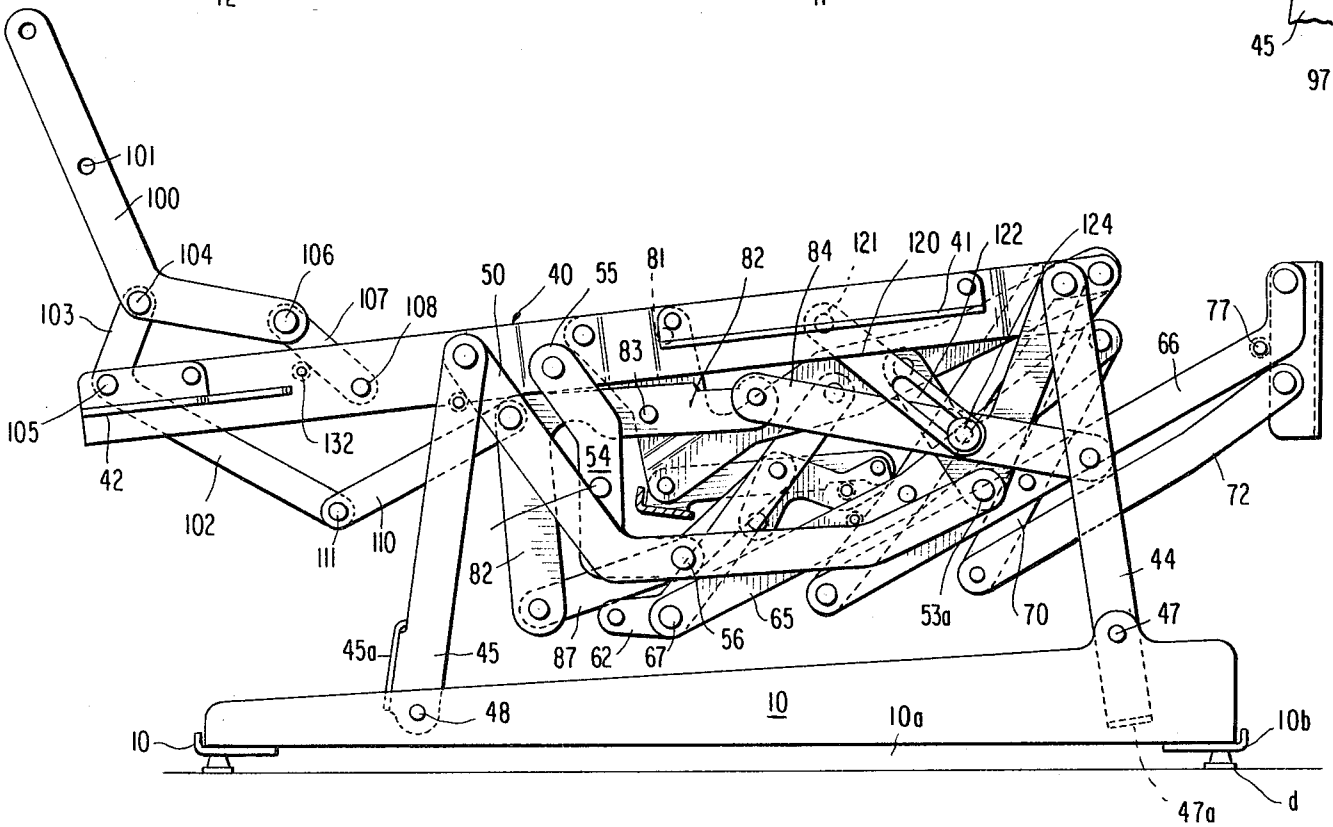
Figures 3, 3A, 3B:
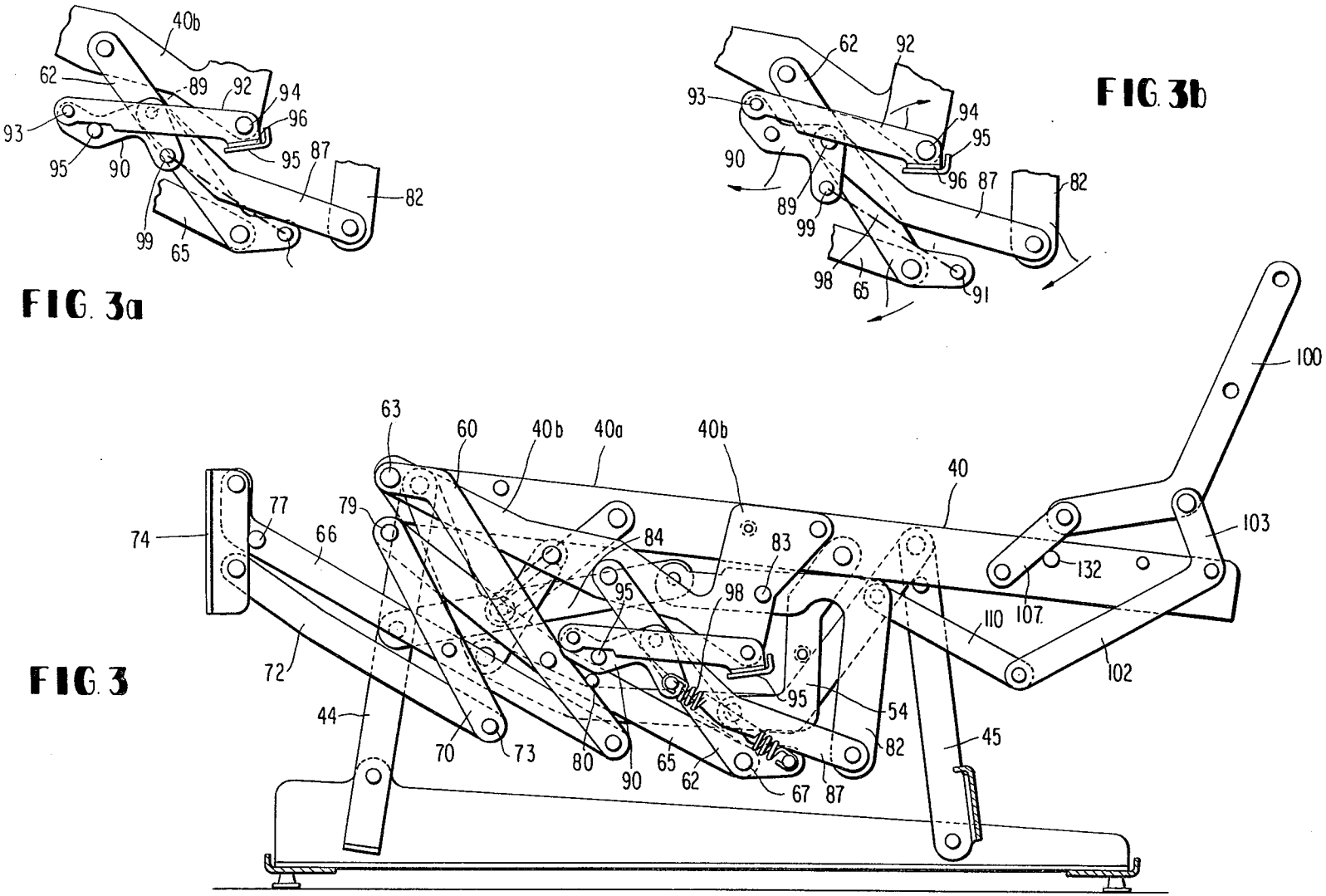
FIG. 3 is a view of the same linkage mechanism shown in FIG. 1 except as seen from the opposite side thereof.
Figures 4, 4A:
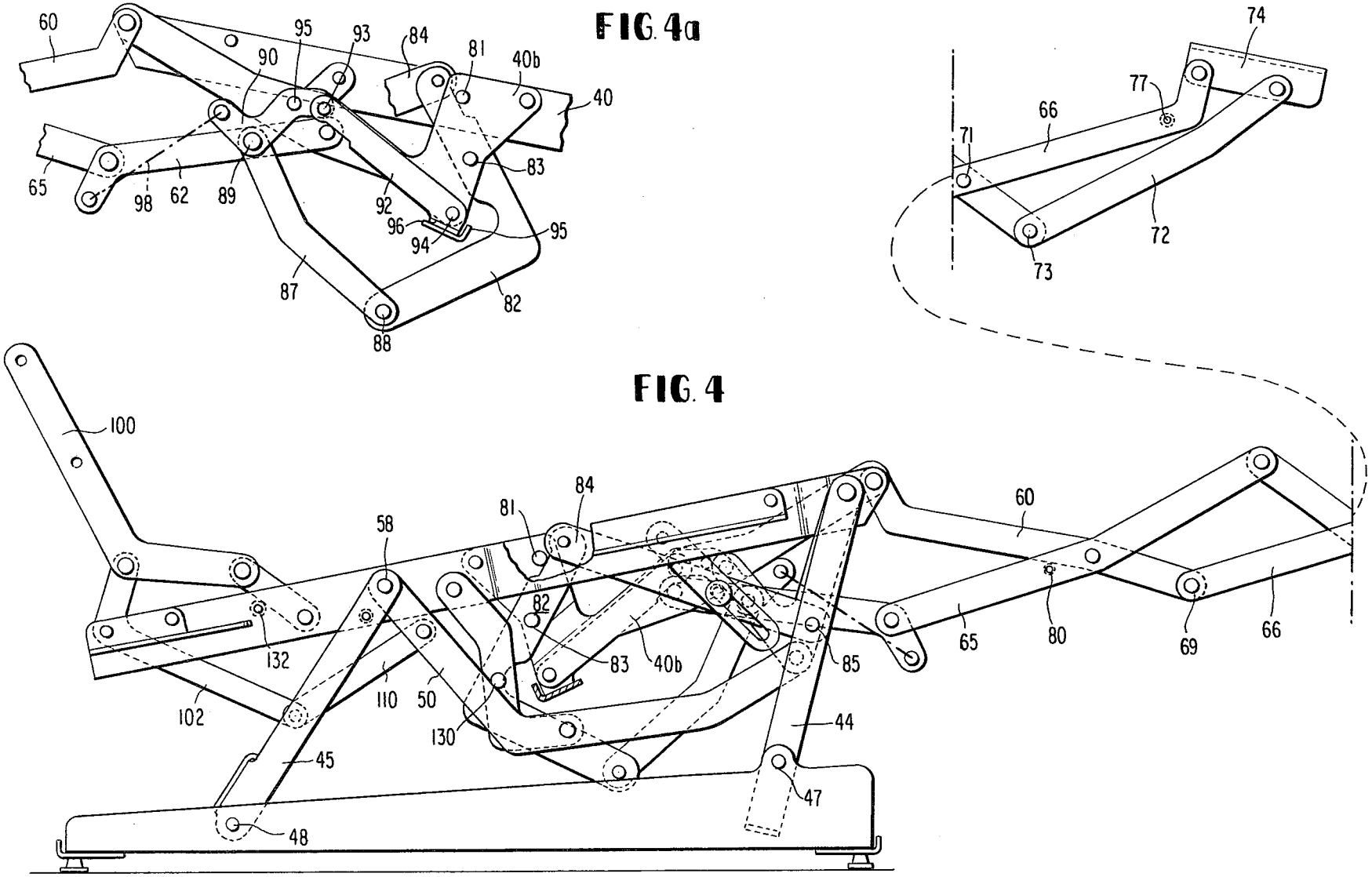
Figure 5:
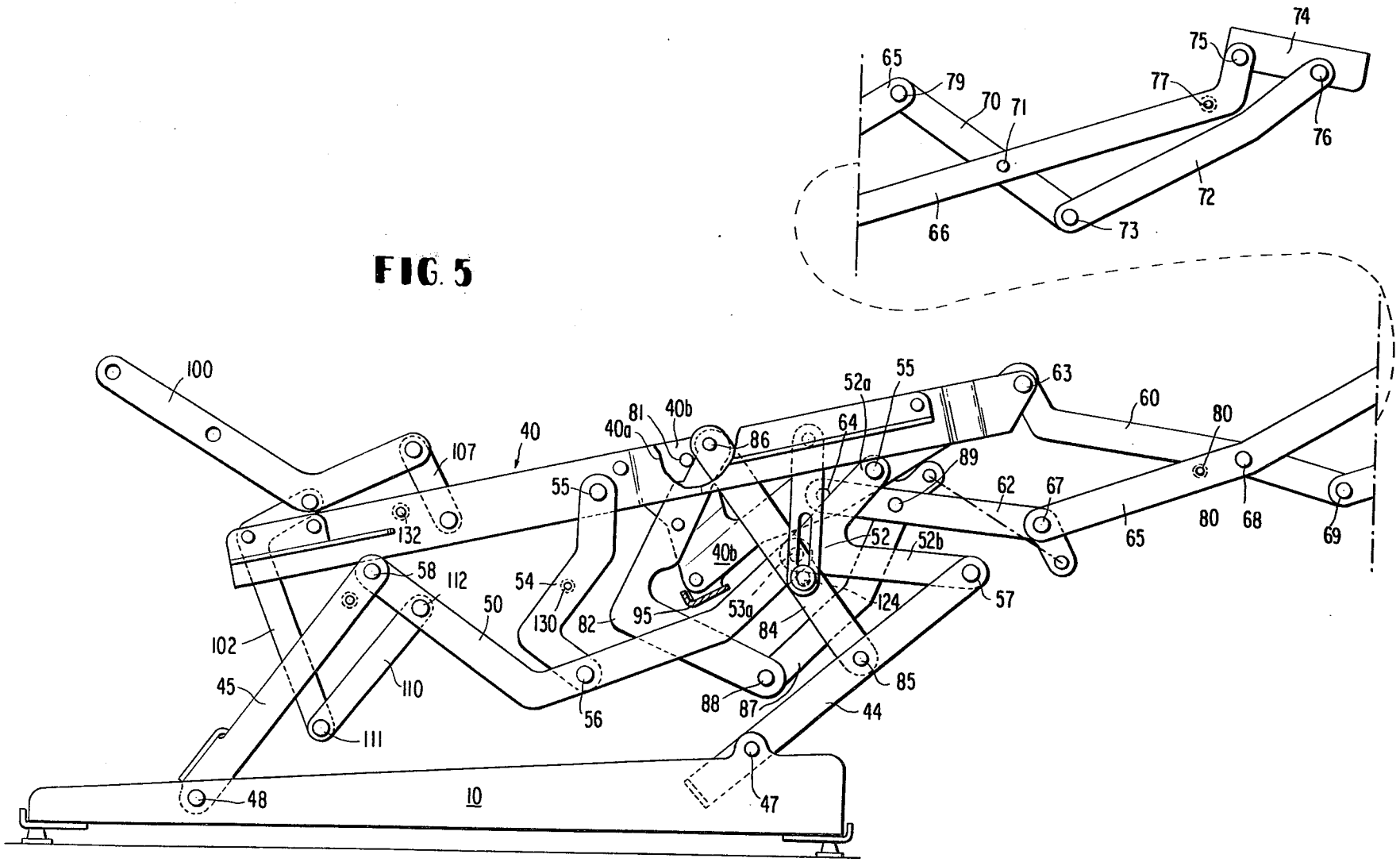
Figure 6:
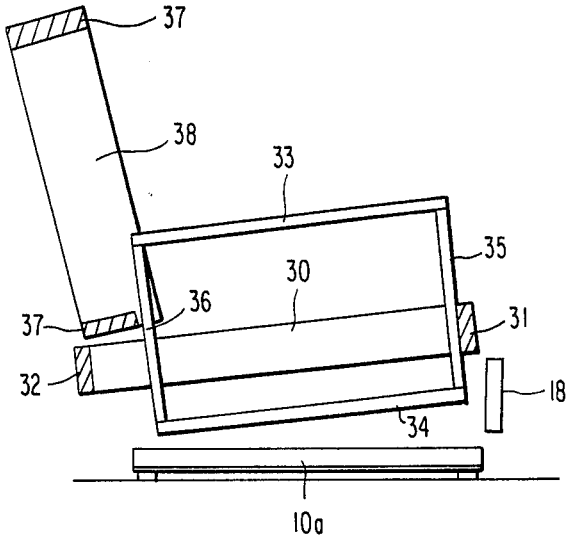
Figure 7:
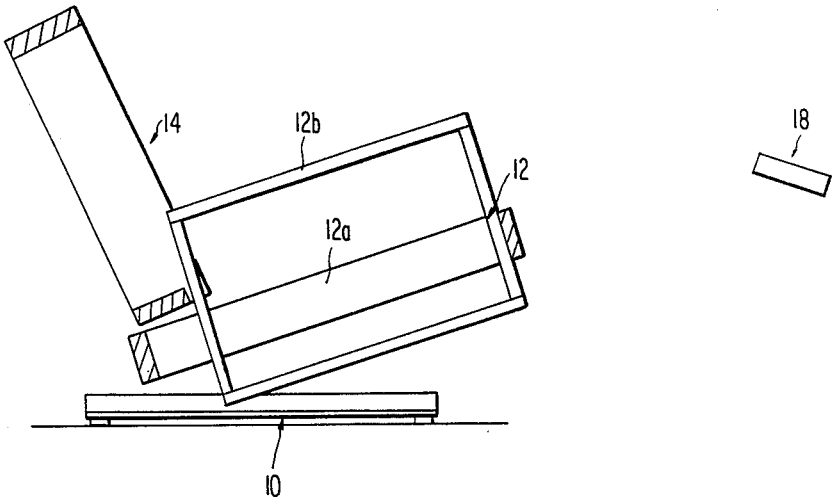
Figure 8:
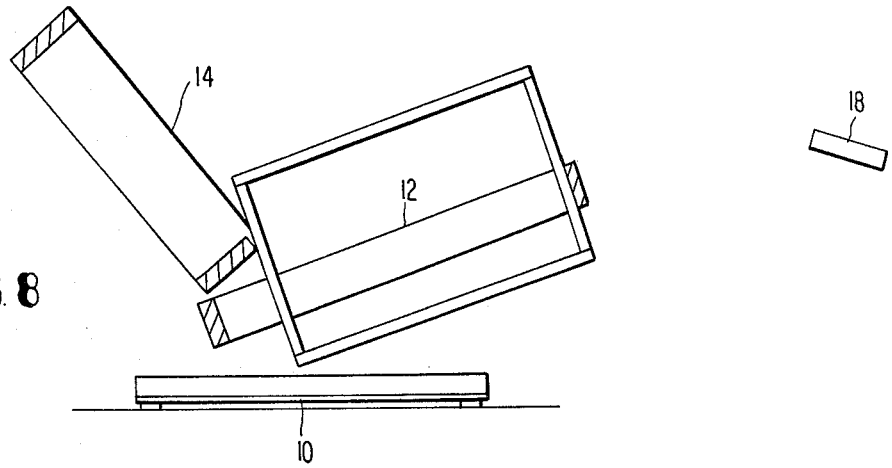

FIG. 3*a* is a fragmental view of portions of FIG. 3 illustrating the closed position of a lock mechanism included in the linkage mechanism;

FIG. 3*b* is a view generally similar to FIG. 3*a* except that the lock mechanism is shown in position just after it has been released or opened;

FIG. 4 is a view generally similar to FIG. 1 except that the linkage mechanism is shown in the TV position;

FIG. 4*a* is a fragmental view of a portion of the mechanism shown in FIG. 4 as seen from the opposite side;

FIG. 5 is a view generally similar to FIG. 4 except that the mechanism is shown in the fully reclined position;

FIG. 6 is a side elevational view of a three-way, wall-avoiding, recliner chair illustrated with its basic frame parts only and which may incorporate the linkage mechanism (not shown) of the present invention; the chair being shown in the normal or generally upright or closed position corresponding to that of the linkage mechanism shown in FIG. 1;

FIG. 7 is a view generally similar to FIG. 6 except that the chair is shown in the TV position corresponding to that of the linkage mechanism shown in FIG. 4; and FIG. 8 is a view generally similar to FIG. 7 except that the chair is shown in the fully reclined position corresponding to that of the linkage mechanism shown in FIG. 5.

DETAILED DESCRIPTION

Referring now to the drawings in detail, there is shown for illustrative purposes only, a three-way, wall-avoiding, recliner chair embodying the present invention in its preferred form. Referring to FIG. 7, the basic chair parts include a fixed base 10 which rests on the floor, a seat and armrest unit generally designated 12 mounted by a seat linkage system to be described, for movement relative to the base; a backrest 14 mounted relative to the seat for movement with the seat as a unit when the chair moves to TV position and for movement relative to the seat when the chair moves into advanced reclining positions beyond TV position, this mounting of the backrest being achieved through a backrest linkage to be described; and a footrest 18 movable by a footrest mechanism to be described for movement between a retracted position shown in FIG. 6 and an extended position projected forwardly from the chair shown in FIG. 7, this position also being referred to in industry as the TV position. The seat and armrest unit 12 includes a seat 12*a*, the armrests 12*b* rigidly united with each other as one piece.

In accordance with the present invention as will be described in more detail below, the chair is automatically actuated from the closed or generally upright position illustrated in FIG. 6 to the TV position illustrated in FIG. 7 by means of the chair-occupant's weight which actuates the linkage mechanism upon release of a lock mechanism. The latter is achieved through release which, in the specific embodiment described below, includes a small lever or handle which is not shown in FIGS. 6, 7 and 8 but which will be described below. The chair is moved to advanced or more pronounced reclining positions by the chair occupant simply applying back pressure to the backrest; FIG. 8 illustrating the fully reclined position.

THE CHAIR FRAME

Referring now to FIG. 6, the frame of the chair may have any suitable construction such as that illustrated in which the seat frame includes side rails 30 interconnected by front and rear cross pieces 31 and 32. The seat frame is rigidly fixed to the armrest frame which includes an upper armrest rail 33 and a lower armrest rail 34 interconnected by front and rear vertical frame members 35 and 36 which are fixed to the side rails 30 of the seat frame. For purposes of clarity, the upholstery has not been shown, however, any suitable upholstery may, of course, be fabricated on the frame.

As will be described below, a linkage mechanism at each side of the chair mounts the unitary seat and armrest unit relative to the base 10, the latter including opposite side frame members 10*a* joined at its front and rear ends by cross pieces 10*b* and 10*c* (see FIG. 1). If desired, low friction glides 10*d* may be provided at the four corners of the base. Although the base frame members may be made from any suitable material such as wood, they are shown as being made from steel angle members. The seat and armrest frame parts have been shown and described as being made from wood, although any other suitable material may be employed. Referring to FIG. 6, the frame of the backrest may also be made with a similar construction, that is, cross pieces 37 joined by vertical pieces 38 to form a generally rectangular configuration. Vertical pieces 38 are interconnected to the seat frame 30 by means of a backrest linkage to be described below. It should be understood that the above-described and illustrated chair frame has been utilized for purposes of disclosing the invention and that other frame constructions and materials may be employed in carrying out the present invention.

THE LINKAGE SYSTEM ON THE RIGHT-HAND SIDE OF THE CHAIR

The linkage system (also referred to as "mechanism") for mounting and operating the various parts of the chair described above includes two linkage mechanisms, one on each side of the chair, one mechanism being a mirror image of the other except for the lock release handle positioned on the right-hand side of the chair, that is, the side that would be on the right of the chair occupant. For purposes of the present invention, only one linkage mechanism need be described, and with reference to FIGS. 1 through 5, there is shown the mechanism that is positioned on the right-hand side of the chair, that is, the side that will be positioned on the right of the chair occupant.

SEAT MOUNTING LINKAGE

The linkage for mounting the seat and armrest unit to the base will be referred to herein as the "seat mounting linkage" or "seat linkage". As the backrest is mounted to the seat and armrest unit, it is mounted relative to the base by the same seat mounting linkage.

Figure 2:
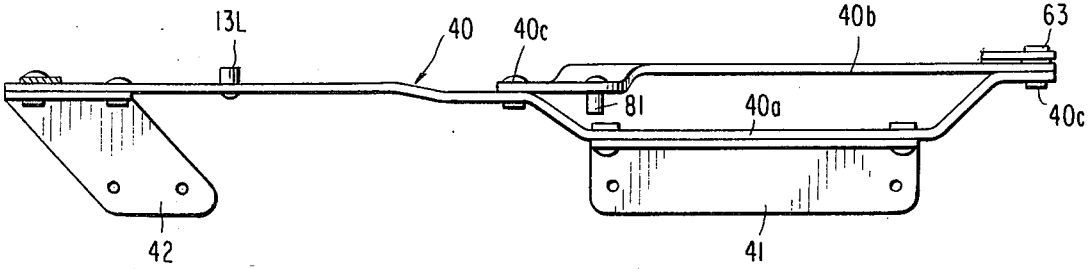
FIG. 2 is a top plan view of a portion of the linkage mechanism included in FIG. 1 which fastens to the seat frame of an associated chair (not shown)

Referring to FIGS. 1 and 2, the seat mounting linkage in the preferred embodiment shown, includes a seat link generally designated 40 which is elongated and extends in the forward-rearward direction of the chair where it is fixed to an associated side rail (30 in FIG. 6) of the seat frame to move with the seat frame and, of course, the armrests as a unitary part. The seat and armrest unit in the preferred embodiment shown, is fixed to seat link 40 by means of flanges 41, 42 projecting outwardly from seat link 40 as best shown in FIG. 2 for receiving and supporting the seat and armrest unit. Apertures shown in FIG. 2 are provided through flanges 41 and 42 for receiving any suitable fasteners for positively securing the seat and armrest unit. As best shown in FIGS. 2 and 3, seat mounting link 40 is formed with dual body portions 40*a* and 40*b* in the forward section thereof which are fixed to each other in any suitable manner by rivets and pivots 40*c* shown in FIG. 2. Note that seat link sections 40*a* and 40*b* are spaced laterally from each other (FIG. 2) and also section 40*b* depends below section 40*a* (FIG. 3) which is part of the main body of seat link 40. Flanges 41, 42 for mounting the seat and armrest unit are fastened in any suitable manner, such as by rivets, to the seal link as best whown in FIG. 2.

Seat link 40 is mounted to base 10 by linkage including what will be termed a "front primary seat mounting link" 44 and a "rear primary seat mounting link" 45 pivotally mounted to forward and rearward locations of base 10 by pivots 47 and 48, respectively, see FIGS. 1 and 5. As best shown in FIG. 5, seat link 40 is mounted with respect to primary seat mounting links 44, 45 through intermediate means which includes what will be termed a "carrier link" 50 extending in the forward-rearward direction of the chair, and a pair of what will be termed "front and rear secondary seat mounting links" 52 and 54. Front secondary seat mounting link 52 is pivotally mounted to the seat link section 40*a* by pivot 53 and is pivotally connected to the front end portion of carrier link 50 by pivot 53*a* (see FIG. 1). Rear secondary seat mounting link 54 is pivotally mounted to seat link 40 by pivot 55 and is pivotally connected to the carrier link 50 at an intermediate location thereof by pivot 56. In turn, carrier link 50 is mounted at its rear end by pivot 58 to rear primary seat mounting link 45. The forward end portion of carrier link 50 is mounted with respect to the front primary seat mounting link 44 by means of a portion 52*b* of front secondary seat mounting link 52 which portion is pivoted at 57 to link 44. It will be noted from FIG. 5 that the front secondary seat mounting link 52 has a generally V-shape including a leg 52*a* which, as noted above, is pivoted by pivot 53 to seat link 40 and leg 52*b* which has just been described as pivoted by pivot 57 to primary seat mounting link 44.

In moving from the closed position shown in FIG. 1 to the TV position shown in FIG. 4, the front and rear primary seat mounting links 44 and 45 pivot clockwise (as viewed in FIGS. 1, 4) about their pivots 47 and 48 to the base 10 with the top of link 44 moving along an arc to the top of its arc and then downwardly away from the top of its arc and with link 45 moving along an arc downwardly away from the top of its arc; it being clear from FIG. 1 that in the normal or closed position, link 44 is positioned to the left of a line perpendicular to the plane of the base passing through its pivot 47, and link 45 is positioned to the right of a line perpendicular to the base 10 and passing through pivot 48. That is to say, that in the closed position shown in FIG. 1, the top of link 44 is before the top of its arc, while the top of link 45 is beyond the top of its arc. It should further be noticed that during movement from the closed position shown in FIG. 1 to the TV position shown in FIG. 4, links 44, 45 move as though they were included with seat link 40 and base 10 in a four-bar linkage. Thus, the distance between the top pivots 57 and 58 of links 44 and 45 is the same when the chair is in the closed position shown in FIG. 1 and the TV position shown in FIG. 4. It should further be noted that in achieving this condition, carrier link 50 and its associated secondary seat mounting links 52 and 54 have not moved relative to the seat link 40 when the chair moves between the closed position of FIG. 1 and the TV position of FIG. 4. It should further be noted that the movement of the chair to the TV position shown in FIG. 4 from the closed position of FIG. 1, causes the seat link 40 to move forwardly (while swinging into recline position) relative to the base 10 while primary seat mounting links 44, 45 swing in a clockwise direction (as viewed in FIGS. 1, 4) forwardly relative to the base and seat link 40. This movement is achieved by virtue of the weight of the chair occupant which, because of the dimensioning and arrangement of the links 44 and 45 in relation to the base 10 and the seat link 40, will cause the links 44 and 45 to move clockwise into the TV position as described. As will be described below in detail, and in accordance with the invention, a lock mechanism is provided for preventing the chair from moving into the TV position of FIG. 4 from the closed position of FIG. 1 until such time as the chair occupant releases the lock mechanism and thus permits the occupant's weight to drive the primary seat mounting links 44 and 45 into the TV position as described above.

FOOTREST MECHANISM

When the chair moves into the TV position, the footrest generally designated 18 is automatically unfolded into its extended position as shown in FIG. 4. This is achieved through a footrest linkage and an operative or driving connection between the footrest linkage and one of the primary seat mounting links, preferably the front primary seat mounting link 44. The footrest linkage in the embodiment shown is of the pantograph or lazy-tong type and includes footrest mounting links 60 and 62 mounted to seat link 40 by pivots 63 and 64, respectively as best shown in FIGS. 3 and 5. Links 60 and 62 move generally parallel to each other. In addition, the footrest linkage includes a second pair of generally parallel extension links, namely 65 and 66; seat link 65 being pivotally connected by pivot 67 to footrest mounting link 62 and also being pivotally connected by pivot 68 at an intermediate portion thereof to footrest mounting link 60. The footrest linkage further includes another pair of links, namely 70 and 74, the latter being an L-shaped bracket utilized to mount footrest 18. Link 70 is pivotally connected by pivot 79 at one end to the forward end of link 65 and is pivotally connected by pivot 73 at its opposite end to another footrest link 72; the latter being pivotally connected by pivot 76 to bracket 74. Link 70 is further pivotally connected by pivot pin 71 at an intermediate section thereof to an intermediate section of link 66, the latter being pivotally connected by pivot 75 to bracket 74.

It will be appreciated from FIG. 5 that the footrest linkage is composed of three sets of four-bar linkages, the first four-bar linkage being constituted by links 74, 72, a portion of 66, and a portion of link 70; the second four-bar linkage being constituted by portions of links 66, 70, 65 and 60; and the last four-bar linkage being constituted by links 60, 62, a portion of link 65, and a portion of the seat link 40. These four-bar linkages move between an open position when the footrest is extended and a closed or substantially closed position when the footrest is retracted. The closed position of the footrest linkage is positively determined by a stop 77 fixed on footrest link 66 to be engageable with bracket 74 as shown in FIG. 1. Another stop 80 is fixed to footrest link 65 to be engageable with the edge of footrest mounting link 60 as shown in FIGS. 3 and 4 to define the closed position of the footrest linkage.

FOOTREST ACTUATING SYSTEM

The footrest linkage just described above is moved to extended position when the chair moves to TV position by a driving force emanating from the front primary seat mounting link 44. Referring now to FIGS. 4*a* and 5, in the preferred embodiment shown, this is carried out by means of a bell crank 82 mounted by pivot 83 to the seat link section 40*b* to swing in response to movement of front primary seat mounting link 44 which movement is transmitted to bell crank 82 by means of a connecting link 84 having one end pivotally connected by pivot 85 to an intermediate portion of front primary seat mounting link 44. The opposite end portion of connecting link 84 is pivotally connected to the end of one leg of bell crank 82 by pivot 86. As seen in FIG. 5, the upper ends of bell crank 82 and its associated connecting link 84 are received in the space between seat link sections 40*a* and 40*b*. The lower leg of bell crank 82 as seen in FIGS. 4*a* and 5, is pivotally connected to one of the footrest mounting links, preferably 62 by a connecting link 87. Pivot 88 interconnects link 87 with the lower leg of bell crank 82 while pivot 89 interconnects the opposite end of link 87 with an intermediate portion of footrest mounting link 62.

It will thus be seen that an operative or driving connection is established between the front primary seat mounting link 44 and the footrest mounting link 62 such that when the former is moved in a clockwise direction from the closed position of FIG. 1 to the TV position of FIG. 4, it will rotate the bell crank 82 about pivot 83 through means of its connecting link 84 which will move connecting link 87 forwardly for unfolding the footrest link 62 and, in turn, the entire footrest mechanism from the retracted position shown in FIG. 1 to the extended position shown in FIG. 4. As noted above, the primary energy or force for achieving such movement of the footrest to TV position is derived from the weight of the occupant directed downwardly in the chair causing the front and rear primary seat mounting links 44, 45 to move relative to the base which remains fixed and the seat link 40 which moves forwardly relative to the base.

In order to provide a positive stop position for bell crank 82 when the footrest has been moved to extended position, a stop 81 is fixed to the seat link section 40*b* to project into the space between seat link sections 40*a* and 40*b* (see FIG. 2) for engaging the rear edge of bell crank 82 when the footrest has been moved to the extended position, see FIGS. 4, 4*a* and 5.

In order to retract the footrest linkage from its extended position shown in FIG. 4 to the closed position shown in FIG. 1, it is necessary to reverse the sequence of movements described above and this is accomplished by the occupant merely exerting pressure on the footrest with the bottom of his legs or feet to fold the footrest mechanism into the retracted position.

LOCK MECHANISM RETAINING THE SEAT AND FOOTREST LINKAGES IN CLOSED POSITION

Since the linkage mechanism which supports the seat and backrest unit relative to the base will urge the chair to the TV position under the weight of the occupant as described above, it is necessary to prevent such movement when the chair is in the closed position and until such time as the chair occupant desires to move into the TV position. This is achieved by a lock mechanism which releasably prevents movement of the front and rear primary seat mounting links 44 and 45 in response to the occupant's weight.

Referring now to FIGS. 3, 3*a* and 3*b*, in the preferred embodiment, the lock mechanism includes what will be referred to as a "knuckle linkage" including a first knuckle link 90 pivotally mounted intermediate its ends to an intermediate portion of footrest mounting link 62 by the same pivot 89 which connects link 87 which interconnects footrest mounting link 62 and bell crank 82. The knuckle linkage further includes a second knuckle link 92 having its forward end pivotally connected by a pivot 93 to one end of the first knuckle link 90; the second knuckle link 92 being pivotally mounted on section 40*b* of seat link 40 by pivot 94. As shown in FIG. 3*a*, the knuckle links 90, 92 are arranged such that in the closed position of the mechanism fully shown in FIG. 3, the lower edge of knuckle link 92 will engage a stop 95 fixed to one side of knuckle link 90. In addition, in this position, the mounting pivot 89 of the first knuckle link 90 is at an elevation slightly higher than a line drawn between pivots 93 and 94. Thus, any forces tending to open the linkage mechanism to place the chair in TV position would tend to urge the knuckle link 90 in a clockwise direction as viewed in FIG. 3*a* which, in turn, would keep knuckle links in their closed or locked positions which, of course, would prevent extension of link 87 interconnecting the footrest mounting link 62 and bell crank 82, thus maintaining the mechanism in closed position.

In order to release the lock mechanism described above, it is merely necessary to pivot the knuckle linkage 90, 92 in a clockwise direction as viewed in FIG. 3 to cause their separation and thus, lower the elevation of pivot 89 below the line drawn between pivots 93 and 94 as illustrated in FIG. 3*b* at which point the force transmitted to bell crank 82 by the occupant's weight will become immediately effective to rotate bell crank 82 in the direction of the arrows shown in FIG. 3*b* which, in turn, will cause connecting link 87 to unfold the footrest mounting link 62, thereby causing the remainder of the footrest to move into the extended TV position.

LOCK RELEASE

Movement of the knuckle linkage 90, 92 to release the lock imposed on the footrest mechanism as described above is accomplished by what will be termed a "release" which, in the embodiment disclosed, includes a shaft which, in the specific embodiment, is formed by an angle bar 95 projecting laterally from the mechanism and being fixed in any suitable manner to knuckle link 92 so as to be capable of rotating knuckle link 92 about pivot 94 thereby displacing its pivot 93 to a position above pivot 89 as shown in FIG. 3*b* to allow connecting link 87 to drive the footrest to extended position as described above. In the specific form shown, angle bar 95 is fixed to a flange portion 96 projecting laterally from the plane of knuckle link 92 and overlying angle bar 95. In order to rotate angle bar 95 for operating knuckle link 92, any suitable member or handle may be secured to angle bar 95 to be within easy reach of the chair occupant. One such handle is shown in FIG. 1*a* at 97.

It will be seen that when the chair is in the closed position shown in FIG. 1, counterclockwise rotation of handle 97 will separate the knuckle links 90 and 92 from their position shown in FIG. 3*a* into the position shown in FIG. 3*b*, whereupon the weight of the chair occupant will become effective to unfold the footrest into extended position. During the latter movement, knuckle link 90 will continue to pivot about its pivot 89 approximately 180° into a position wherein the pivotal interconnection at 93 between the knuckle links 90 and 92 will be to the right of pivot 89 as shown in FIG. 4*a*. Pivot 89 will also then be positioned below pivot 93.

When the footrest is moved from the extended position shown in FIG. 4 back to its retracted position shown in FIG. 1 which as noted above is accomplished by the occupant applying pressure with his legs and feet on the footrest, the knuckle links 90 and 92 will move from their position shown in FIG. 4*a* back to the closed position shown in FIG. 3*a*. However, in order to assist the final closing movement of the knuckle linkage from the position such as shown in FIG. 3*b* to the closed position shown in FIG. 3*a*, a spring means is provided which, in the specific form shown, is a tension spring 98 having one end anchored about a stud 91 projecting from a small crank portion on the end of footrest mounting link 62. The other end of spring 98 is fixed about a stud 99 fixed to one end of knuckle link 90. Spring 98 is shown in phantom lines in FIGS. 3*a*, 3*b* and 4*a*, however, the spring is shown in partly solid lines in FIG. 3. During return of the footrest to its retracted position by the force of the occupant's feet, when the lock mechanism reaches the position, for example shown in FIG. 3*b*, spring 98 will be tensioned to a sufficient degree to cause knuckle link 90 to positively pivot about its pivot 89 into the locked position (shown in FIG. 3*a*) which will be determined upon engagement of knuckle link 92 with stop 95 on knuckle link 90. Although the tension on the knuckle linkage imposed by the spring 98, when in the closed position shown in FIG. 3*a*, is not as great as the tension when the knuckle linkage is in the position shown in FIG. 3*b*, the weight of the occupant will have the effect of maintaining the lock mechanism in the closed position of FIG. 3*a* as described above. Similarly, but with opposite effect, the spring 98 will have a slight biasing effect tending to maintain the footrest in its extended position when the chair is in the TV position, however, more significant will be the effect of the occupant's weight which will maintain the footrest in the extended position.

It should also be noted that the amount of force required to release the lock mechanism to permit the chair to move into TV position is very slight requiring only slight downward pressure on and movement of handle 97 in the clockwise direction as viewed in FIG. 1*a* sufficient to slightly displace the knuckle link pivots 93, 89 relative to each other. This is to be contrasted with the force heretofore that has been required to manually drive the footrest from retracted to extended position with the use of a manual handle. In the present case, once the lock mechanism is released by slight depression of handle 97, the chair linkage mechanism will automatically move into the TV position by virtue of the occupant's weight. No additional driving force or manipulation is required of the occupant throughout the movement of the footrest to the extended position. Also, no significant leverage is required of the handle 97 which undergoes only slight movement and therefore may be designed in an unobstrusive size and shape.

It will be appreciated that although a specific lock mechanism and release has been disclosed herein, other lock mechanisms and released structures may be utilized in carrying the broad purposes of the invention.

It should be noted that although not shown, shaft 95 extends entirely across the chair to the linkage mechanism on the opposite side of the chair so that both linkage mechanisms may be unlocked when the release handle 97 is depressed. This also helps to stabilize the linkage mechanisms on opposite sides of the chair. In addition, the mechanisms in the preferred embodiment are further stabilized by cross members 45*a* and 47*a* which extend between the lower ends of the front and rear primary seat mounting links 44 and 45, see FIG. 1.

THE BACKREST LINKAGE AND ADVANCED RECLINING POSITIONS

Backrest 14 is mounted to the seat by means of a backrest linkage including a backrest mounting link 100 which is fixed to vertical frame portion 38 of the backrest frame by fasteners received through apertures 101, see FIG. 1. Backrest link 100 has a generally L-shape and its bend portion is pivotally mounted relative to seat link 40 by what will be termed a "backrest drive" link 102, the latter having an upper portion 103 pivoted at 104 to the bend portion of backrest mounting link 100. At an intermediate portion thereof, backrest drive link 102 is pivoted by pivot 105 to seat link 40, see FIG. 1. The forward lower end of backrest link 100 is pivoted by pivot 106 to one end of a small link 107 which, in turn, is pivotally mounted to seat link 40 by pivot 108. Links 100, 103, 107 and the rear portion of seat link 40 make up a four-bar linkage which after the chair is in TV position, may be actuated by the chair occupant applying back pressure to the backrest to move the backrest relative to the seat and to place the seat 40 in an advanced reclined position relative to the base 10 as will now be described.

In order to drive the seat and backrest into advanced reclining positions beyond TV position relative to the base 10, the backrest drive link 102 is operatively connected by link 110 to carrier link 50. In the specific form shown, backrest drive link 102 has its lower end pivoted by pivot 111 to one end of link 110 while the opposite end of link 110 is pivoted by pivot 112 to carrier link 50 adjacent to the rear end of the latter, see FIG. 5.

As noted above, when the chair moves from the closed position of FIG. 1 to the TV position of FIG. 4, carrier link 50 and the secondary seat mounting links 52 and 54 do not move relative to the seat, and it is only the seat link 40, the primary seat mounting links 44 and 45 that move relative to each other and the base 10 as in a four-bar linkage. This is achieved by a sequencing mechanism which in the preferred embodiment includes a "sequencing" link 120 having its upper end pivotally mounted by pivot 121 to the inside surface of seat link section 40*a*. Link 120 has extending in its lower end portion, an elongated slot 122 receiving a pin 124 fixed to an intermediate position of link 84 which link serves to transmit driving force from the primary front seat mounting link 44 to the bell crank 82 as described above. When the chair is in the closed position shown in FIG. 1, pin 124 will be in the lower end of slot 122 in the sequencing link 120 as shown in FIG. 1. This will have the effect of preventing the backrest from being moved relative to the seat. However, once the chair is moved out of the closed position towards the TV position, due to rotation of link 84, pin 124 will ride upwardly in slot 122 thereby permitting the backrest to be reclined relative to the seat by the occupant exerting pressure on the backrest while opening or extending his body. This will also cause the backrest drive link 102 acting through the link 110 to actuate the four-bar linkage comprised of seat link 40, portions of carrier link 50, and secondary seat mounting links 52 and 54 causing the seat link 40 and the seat to swing into advance reclining positions forwardly and upwardly relative to the base, the fully advancing reclining position, of course, being shown in FIG. 5.

During movement of the chair towards the fully advanced reclining position shown in FIG. 5, the secondary seat mounting links 52 and 54 pivot forwardly in a clockwise direction as viewed in FIG. 5 about their pivots 56 and 53*a*, thereby causing the seat link 40 to be swung forwardly by the upper end portions of secondary seat mounting links 52 and 54. During movement of the chair from the TV to the fully recline position shown in FIG. 5, the position of the footrest linkage relative to the seat remains the same but of course changes relative to the base as a unit with the seat.

Should the occupant desire to return to TV position or to a lesser reclining position, he merely has to remove or reduce pressure from the backrest which will cause the secondary seat mounting links 52 and 54 to swing rearwardly in a counterclockwise direction as shown in FIG. 5 and such movement eventually will be limited by a stop 130 fixed to rear secondary seat mounting link 54 to be engageable with the forward edge of carrier link 50 as shown in FIGS. 1 and 4. The generally upright or normal position of the backrest is also positively determined through means of a stop 132 fixed to seat link 40 to be engageable with the edge of link 107 as shown in FIG. 1.

SUMMARY OF OPERATION

Assuming the chair is in the generally upright position with the linkage mechanism closed as shown in FIG. 1, an occupant may sit in the chair and the chair will remain in the closed position because of the lock mechanism which restrains the linkage mechanism from moving towards TV position under the weight of the occupant. When in this closed position, it is not possible to recline the backrest relative to the seat due to the sequencing mechanism. When it is desired to move the chair into the TV position, the occupant merely depresses the release handle 97 (see FIG. 1*a*) in the counterclockwise direction as viewed in FIG. 1*a* which has the effect of moving the lock mechanism from the position shown in FIG. 3*a* to the position shown in FIG. 3*b*. The weight of the occupant will now become immediately effective to swing the primary front and rear seat mounting links 44, 45 forwardly in a clockwise direction from the position shown in FIG. 1 towards the position shown in FIG. 4 during which time links 44, 45, seat link 40 and base 10 will act as though they were a four-bar linkage. This movement will advance the seat forwardly relative to the base to provide a certain amount of wall-avoiding action so that if the backrest is placed adjacent a nearby wall, it will avoid striking the wall. This latter movement of the linkage mechanism will cause bell crank 82 to be pivoted forwardly by virtue of a driving force emanating from front seat mounting link 44 acting through connecting link 84 to rotate bell crank 82 which, in turn, will actuate footrest mounting link 62 through connecting link 87 to extend the footrest.

During such movement of the chair mechanism, as soon as stop 124 rides up the slot 122 of the sequencing link 120, the backrest will be free for reclining movement relative to the seat. All the chair occupant need do is to apply back pressure on the backrest to achieve the latter which will also cause backrest drive link 102 acting through link 110 to swing secondary seat mounting links 52, 54 carrying with them the seat. During this latter movement, primary seat mounting links 44 and 45 will also continue to move relative to the base to provide further wall-avoiding action. The fully reclined position of the chair shown in FIG. 5 will be determined by engagement of stop 124 in the bottom edge of slot 122 in the sequence link 120 as shown in FIG. 5. In this connection, compare FIG. 4 when the chair is shown in the TV position with the stop 124 engaged along the upper edge of the slot 122 and FIG. 5 when the chair has been moved to the fully reclined position causing the sequencing link 120 to rise relative to stop 124 until the lower slot edge thereof engages stop 124 as shown in FIG. 5. In between TV and fully reclined positions, the chair may be balanced in any advanced reclining position by virtue of the distribution of the occupant's weight.

To return to TV position, the operator merely has to lean forward in the chair redistributing his weight which will cause the secondary seat mounting links 52 and 54 to swing in reverse direction or rearwardly until the stop 130 or rear secondary seat mounting link 54 engages carrier link 50. Also at this point in time, stop 132 on seat link 40 will engage link 107 to limit movement of the backrest relative to the seat.

Should the chair occupant then wish to return the chair to the normal or closed position, he merely applies pressure on footrest 18 with the back of his legs or feet which will not only fold the footrest to retracted position but also, will cause the primary front and rear seat mounting links 44, 45 to be rotated in reverse direction into the closed position shown in FIG. 1.

It will thus be seen from the above, that the present invention provides a recliner chair that achieves wall-avoiding action solely through means of a linkage system as opposed to a track and roller system and yet is uniquely actuated into TV position solely through the weight of the chair occupant without the assistance of any springloaded device. Although in the specific embodiment described, a handle release is employed to trigger actuation of the chair to TV position, other forms of releases may be employed within the broader scope of the present invention.

What is claimed is:

1. In a wall-avoiding recliner chair having a fixed base, a seat and backrest mounted on the base, a footrest movable between retracted position adjacent the front of the seat and an extended position projected forwardly from the front of the seat; the improvement comprising in combination, a seat linkage mounting the seat relative to the base for movement in response to the weight of an occupant of the chair between a closed position wherein the footrest is retracted and a reclining position with the seat projected forwardly relative to the base and with the footrest extended, a footrest linkage mounting the footrest relative to the seat for movement between said positions thereof, linkage means interconnecting the footrest linkage and the seat linkage for actuating the footrest between extended and retracted positions in response to movement of the seat linkage caused by the weight of the chair occupant, lock means releasably holding the seat linkage in said closed position against movement into a reclining position under the weight of an occupant of the chair; and release means for releasing the lock mechanism to permit the seat linkage to move from said closed position to a reclining position.

2. The improvement defined in claim 1 wherein said lock means includes two knuckle links movable between a closed position locking the seat linkage against movement out of said closed position thereof and an open position freeing the seat linkage for movement to a reclining position.

3. The improvement defined in claim 2 wherein one of said knuckle links is oscillatable about a first axis intermediate the ends thereof and wherein the other knuckle link is pivoted to the seat and said one knuckle link at spaced pivot points respectively and wherein said first axis is offset from a line interconnecting said spaced pivot points when the lock means is in said closed position.

4. The improvement defined in claim 3 wherein said knuckle links are pivoted to each other at end portions thereof which move to opposite sides of said first axis when the lock means moves between said open and closed positions thereof.

5. The improvement defined in claim 4 wherein said one knuckle link has a stop thereon, and said other knuckle link engages said stop when the lock means is in the closed position thereof.

6. The improvement defined in claim 4 wherein the footrest linkage includes a footrest mounting link pivoted to the seat, wherein said first knuckle link is pivoted to said footrest mounting link for oscillation about said first axis, and wherein said linkage means interconnecting the footrest linkage and the seat linkage includes a link pivoted to said footrest mounting link at said first axis.

7. The improvement defined in claim 6 wherein said linkage means interconnecting the footrest linkage and the seat linkage further includes a bell crank pivoted intermediate its ends relative to the seat, said bell crank being pivotally connected to the last link defined in claim 6 to drive the same, said seat linkage being pivotally connected to the bell crank to drive the same.

8. The improvement defined in claim 7 wherein said seat linkage includes a first primary seat mounting link pivotally mounted to the base and wherein said linkage means interconnecting the footrest linkage and the seat linkage further includes a link pivotally interconnecting the primary seat mounting link and the bell crank to transmit driving force to the latter.

9. The improvement defined in claim 8 wherein said seat linkage further includes a second primary seat mounting link pivotally mounted to the base rearwardly of said first primary seat mounting link, a carrier link having a rear end portion pivotally mounted relative to said rear primary seat mounting link, a first secondary seat mounting link pivotally connected between said carrier link and said seat, a second secondary seat mounting link pivotally connected between said seat and said carrier link, said second secondary seat mounting link also being pivotally connected to said primary seat mounting link.

10. The improvement defined in claim 9 applied to said wall-avoiding recliner chair further including a backrest, and wherein said improvement further includes a backrest linkage pivotally mounting said backrest relative to said seat, said backrest linkage further including a drive link operatively connected relative to said carrier link for swinging said secondary seat mounting links and, in turn, reclining said seat upon application of pressure against the backrest by the chair occupant.

11. The improvement defined in claim 10 wherein there is further included a sequencing means preventing movement of the backrest relative to the seat when the seat linkage is in said closed position but permitting movement of the backrest relative to the seat when the seat linkage is in a reclining position, said sequencing means including a link pivoted to the seat at one end portion thereof and having an elongated slot in an opposite end portion thereof, and a pin received in said slot and fixed to said link which interconnects said primary seat mounting link and said bell crank.

12. The improvement defined in claim 3 wherein said release means includes a rotatable shaft fixed to said other knuckle link and a hand or lever fixed to said shaft and located at one side of the seat for rotating said shaft for releasing said lock mechanism.

13. The improvement defined in claim 12 wherein said lock means includes a spring biasing means for positively moving said knuckle links to said closed position thereof.

14. The improvement defined in claim 6 wherein said lock means includes a spring biasing means for positively moving said knuckle links to said closed position thereof, said spring biasing means including a tension spring having one end fixed to an end portion of said one knuckle link opposite the pivotal connection between said knuckle links, and said spring having its opposite end fixed to said footrest mounting link.

15. The improvement defined in claim 11 wherein said release means includes a rotatable shaft fixed to said other knuckle link and a hand or lever fixed to said shaft and located at one side of the seat for rotating said shaft for releasing said lock mechanism, and wherein said lock means includes a spring biasing means for positively moving said knuckle links to said closed position thereof, said spring biasing means including a tension spring having one end fixed to an end portion of said one knuckle link opposite the pivotal connection between said knuckle links, and said spring having its opposite end fixed to said footrest mounting link.

16. For use in a wall-avoiding, recliner chair of the type including a fixed base, a seat mounted for movement into reclining positions relative to the base, and a footrest movable between a retracted position adjacent the front of the seat and an extended position projected forwardly of the seat; a linkage system comprising a seat link adapted to be fixed to the seat of an associated chair, a base, front and rear primary seat mounting links pivoted to the base at spaced positions therealong in the forward-rearward direction of the chair, a carrier link extending in the forward-rearward direction of the chair, front and rear secondary seat mounting links pivotally mounted to the carrier link and the seat link at spaced positions therealong in the forward-rearward direction of the chair, the rear primary seat mounting link being pivotally connected to a rear-end portion of the carrier link, the front primary seat mounting link being pivotally connected relative to a front end portion of the carrier link, said primary links being movable relative to the base and said seat link in response to the weight of an occupant of an associated chair to place the seat into a reclining position displaced forwardly of the base, a footrest linkage mounted to said seat link for movement between a retracted position and an extended position, said footrest linkage including a footrest mounting link pivotally mounted to the seat link, linkage means interconnecting the front primary seat mounting link and said footrest mounting link for driving the footrest linkage to extended position when the seat moves into reclining position in response to the weight of an occupant of an associated chair, a lock means including a linkage for preventing extension of the footrest from the retracted position, and a release means connected to said lock means for releasing the same for permitting extension of the footrest, and a backrest linkage for pivotally mounting the backrest of an associated chair to the seat link for movement between generally upright and reclining positions, said backrest linkage including a link operatively connected to said carrier link for swinging said secondary seat mounting links relative to the carrier link.

17. The linkage system defined in claim 16 wherein said linkage means interconnecting the footrest mounting link and the front primary seat mounting link includes a bell crank pivoted intermediate the ends thereof to the seat link, a link interconnecting the front primary seat mounting link and one end portion of the bell crank, the other end portion of the bell crank being pivotally connected to the footrest mounting link to drive the same.

18. The linkage system defined in claim 17 wherein said linkage of said lock means includes a first knuckle link pivoted intermediate its ends to said footrest mounting link at a first axis, a second knuckle link pivotally connected at a first pivot to one end portion of said first knuckle link and pivotally mounted to the seat link at a second pivot, said knuckle links being movable between a closed locking position for preventing extension of the footrest and an open unlocking position for freeing the footrest for movement into extended position, said first axis being offset from a line interconnecting said pivots when the knuckle links are in locking position.

19. The linkage system defined in claim 18 wherein said release means includes a hand lever fixed relative to the second knuckle link for moving the knuckle links to said unlocking position.

20. The linkage defined in claim 19 wherein the linkage interconnecting the footrest linkage and the primary seat mounting link includes a link pivotally connected to said other end of the bell crank and pivotally connected to the footrest mounting link at said first axis where the first knuckle link is pivoted to the footrest mounting link.

21. The linkage system defined in claim 20 including a spring means for urging said knuckle links to said closed position thereof, said spring means including a tension spring having one end connected to said first knuckle link and an opposite end connected to said footrest mounting link.

22. The linkage system defined in claim 16 wherein said linkage of said lock means includes a first knuckle link pivoted intermediate its ends to said footrest mounting link at a first axis, a second knuckle link pivotally connected at a first pivot to one end portion of said first knuckle link and pivotally mounted to the seat link at a second pivot, said knuckle links being movable between a closed locking position for preventing extension of the footrest and an open unlocking position for freeing the footrest for movement into extended position, said first axis being offset from a line interconnecting said pivots when the knuckle links are in locking position.

23. The linkage system defined in claim 22 wherein said release means includes a hand lever fixed relative to the second knuckle link for moving the knuckle links to said unlocking position.

24. The linkage system defined in claim 23 including a spring means for urging said knuckle links to said closed position thereof, said spring means including a tension spring having one end connected to said first knuckle link and an opposite end connected to said footrest mounting link.

25. A wall-avoiding reclining chair comprising in combination, a base, a seat, a backrest mounted to the seat, seat linkage means mounting the seat to the base for moving the seat from a first normal position relative to the base to a second reclined position advanced forwardly relative to the base in response to the weight of an occupant of the chair, releasable lock means preventing movement of said seat linkage means to said second position, a release means for releasing said lock means to allow movement of the seat to said second position, said release means including a manually operable lever mounted on one side of the seat for operating the release to release said lock means, a footrest, footrest linkage means mounted to the seat for moving the footrest between a retracted position adjacent the seat and an extended position projected forwardly of the seat in response to movement of the seat linkage means to said second position thereof.

26. The wall-avoiding reclining chair defined in claim 25 wherein said lock means includes first and second knuckle links pivotally interconnected at a first pivot to be movable between a closed position extending in a generally side-by-side interrelationship preventing movement of said seat linkage, and an open position with one knuckle link extending behind the other knuckle link, the first knuckle link being pivotally mounted relative to the footrest linkage and the second knuckle link being pivotally mounted relative to the seat.

27. The wall-avoiding reclining chair defined in claim 26 wherein said manually operable lever is connected to said second knuckle link to pivot the same about its pivotal connection relative to the seat.

28. The wall-avoiding reclining chair defined in claim 27 wherein said lock means includes a stop fixed to one of said knuckle links to engage the other knuckle link to define said closed position thereof.

29. For use in a three-way, wall-avoiding, recliner chair of the type including a fixed base, a seat mounted for movement into reclining positions relative to the base, a backrest mounted to the seat, and a footrest movable between a retracted position adjacent the front of the seat and an extended position projected forwardly of the seat; a linkage system comprising a seat linkage including a seat link adapted to be fixed to the seat of an associated chair, a base, front and rear primary seat mounting links pivoted to the base at spaced positions therealong in the forward-rearward direction of the chair for moving the seat into a reclined position displaced forwardly of the base in response to the weight of an occupant of an associated chair, a footrest linkage supporting said footrest and being mounted to said seat link for moving said footrest between said retracted and extended positions, linkage means interconnecting the front primary seat mounting link and said footrest linkage for driving the footrest linkage and the footrest to extended position when the seat is moved into said reclined position, lock means including a linkage for preventing movement of the seat linkage tending to place the seat into said reclined position, and a release means connected to said lock means for releasing the same for permitting movement of the seat linkage to place the seat into said reclined position and said footrest into extended position in response to the weight of the occupant of the associated chair.

30. The linkage system defined in claim 29 wherein said lock means includes a first knuckle link pivotally mounted intermediate its ends to said footrest linkage at a first axis, a second knuckle link pivotally connected at a first pivot to one end portion of said first knuckle link and pivotally mounted to the seat link at a second pivot, said knuckle links being movable between a closed locking position for preventing movement of the seat linkage and extension of the footrest and an open unlocking position for freeing the seat linkage for movement into said reclined position and the footrest for movement into extended position, said first axis being offset from a line interconnecting said pivots when the knuckle links are in locking position.

31. The linkage system defined in claim 30 wherein said release means includes a hand lever fixed relative to the second knuckle link for moving the knuckle links to said unlocking position.

32. The linkage system defined in claim 31 including a spring means for urging said knuckle links to said closed position thereof, said spring means including a tension spring having one end connected to said first knuckle link and an opposite end connected to said footrest linkage.

* * * * *